United States Patent [19]

Flemming

[11] Patent Number: 4,833,796

[45] Date of Patent: May 30, 1989

[54] GRIPPING ELEMENT FOR SPORTS SHOES AND SOLES UTILIZING SAME

[75] Inventor: Udo Flemming, Erlangen, Fed. Rep. of Germany

[73] Assignee: Puma AG Rudolf Dassler Sport, Herzogenaurach, Fed. Rep. of Germany

[21] Appl. No.: 158,645

[22] Filed: Feb. 22, 1988

[30] Foreign Application Priority Data

Feb. 25, 1987 [DE] Fed. Rep. of Germany ..... 3706068

[51] Int. Cl.[4] ..... A43C 15/16; A43C 15/00

[52] U.S. Cl. ..... 36/134; 36/670

[58] Field of Search ..... 36/134, 670, 128, 67 B, 36/67 R, 61, 62, 67 A

[56] References Cited

U.S. PATENT DOCUMENTS

| | | | |
|---|---|---|---|
| 2,697,288 | 12/1954 | Wilcox | 36/67 B |
| 3,054,197 | 9/1962 | Morgan et al. | 36/67 D |
| 3,766,670 | 10/1973 | Nakajima | 36/67 B |
| 4,380,878 | 4/1983 | Skaja | 36/67 D |
| 4,644,672 | 2/1987 | Dassler et al. | 36/134 |
| 4,667,422 | 5/1987 | Yamaguchi | 36/67 A |
| 4,698,924 | 10/1987 | Greiner et al. | 36/134 |
| 4,712,318 | 12/1987 | Greiner et al. | 36/134 |

FOREIGN PATENT DOCUMENTS

| | | | |
|---|---|---|---|
| 2313646 | 10/1974 | Fed. Rep. of Germany | 36/67 D |
| 3233900 | 3/1984 | Fed. Rep. of Germany . | |

*Primary Examiner*—Steven N. Meyers

*Attorney, Agent, or Firm*—Sixbey, Friedman, Leedom & Ferguson

[57] ABSTRACT

In a gripping element for sports shoes consisting of a cleat having a base portion formed on a sole or fastened to it and that is made of stiffly, elastic material with an insert projecting beyond the base portion that is made of a rigid, highly abrasion resistant material. To reduce the danger of destruction of the insert, particularly by shearing forces, the insert is formed so that the ratio of the maximum diameter (D) of the insert (3) relative to its total height (H) is about 1:7.5 to 1:1.8, the insert (3), in its midsection, has a constriction (E) that divides insert (3) into a tread section (4) and a fastening section (5), the height of the constriction (E) is 25% to 60% of the total height (H) and so that the smallest diameter (e) of constriction (E) is 75% to 45% of maximum diameter (D) of the tread section (4), whereby the insert is able to resiliently deflect so as to move sideways with elastic deformation of the base due to radially imposed loads.

25 Claims, 1 Drawing Sheet

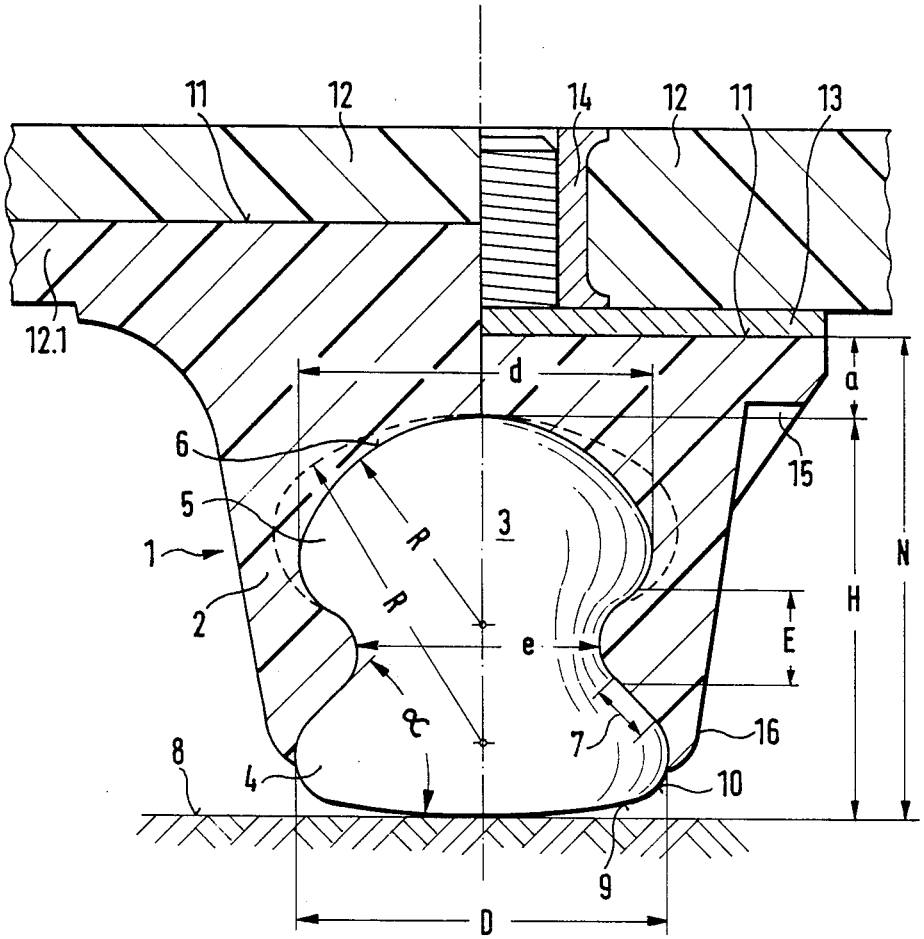
11
12
14
12
11
13
12.1
d
a
6
15
5
3
1
R
R
N
H
2
e
E
α
7
16
8
4
10
9
D

GRIPPING ELEMENT FOR SPORTS SHOES AND SOLES UTILIZING SAME

BACKGROUND AND SUMMARY OF THE INVENTION

The present invention relates to a gripping element for sports shoes, particularly to cleats of a stiffly elastic material which are provided with a projecting insert or rigid, highly abrasion resistant material.

A gripping element of the initially mentioned type is known from German Offenlegungsschrift No. 32 33 900, for example. There, an insert made of oxide ceramics has, in one embodiment, the form of a disk with an outwardly arched tread surface and flat inner surface. At a distance from the flat inner surface, a flat surface of fastening pin is provided. In another embodiment, the insert made of oxide ceramics is formed almost as a pointed cone that is provided with recesses on an inside flange. The flange is coated with plastic and is sunk into the sole.

Another similar cleat insert made of ceramics is known from German Pat. No. 35 32 607 and corresponding U.S. Pat. No. 4,698,924. This insert has the same form as the first mentioned disk, except its inner surface is arched outward slightly and is soldered or glued to a metal fastening element which may be the end of a metal pin or a metal plate or a metal spring end. It is common to all these embodiments that the insert made of ceramics, particularly oxide ceramics, is fastened practically completely rigidly in a cleat-shaped base portion (as is necessary if the soldered or glued connection is not to fracture in use). This applies particularly to the embodiment known from German Pat. No. 35 32 607 and U.S. Pat. No. 4,698,924 in which the ceramic insert is soldered to a pin, and possibly less so to the spring-mounted embodiment.

As is known, ceramics are very abrasion-proof, for which reason this material is especially suitable for gripping elements in certain applications. Ceramics can also withstand very high compression stresses. But ceramics, and also hard alloys, are very brittle, so that they are relatively sensitive to shearing forces and bending forces, and thus are prone to fracturing if rigidly mounted and subjected to the type of forces typically experienced by an athletic shoe cleat.

In U.S. Pat. No. 4,644,672, an outer sole for an athletic shoe is disclosed that has cleats with exchangeable gripping elements that are secured to the sole by being mounted upon studs, of a hard and bending resistant material, which project from the outsole at its ground contacting side. The studs have annular grooves and the gripping elements are in the form of a cap-shaped base that is made of a resilient elastic material and provided with a recess having a shape, with annular ribs, adapted to the outer contour of the stud. As a result, a snap-locking engagement is obtained due to the resiliency of the elastic material of the gripping elements and the mirror-imaged shaping of the stud and recess. Furthermore, to enhance the abrasion resistance of the gripping elements, their tread portion is formed of abrasion resistant material. In particular, a tread portion, in the form of a conical disk or dome made of metal, leather, or a ceramic material, is glued onto the cap-shaped base of the gripping elements and/or is provided with pin-like projections which are inserted or snapped into correspondingly shaped recesses in the cap-shaped base.

While the arrangement of the precedingly described patent is an effective means for providing an athletic shoe sole with exchangeable cleats, the fact that each cleat is formed of three components (a stud, a cap-shaped base, and a tread portion) adds to the cost of producing a sole with such cleats. Furthermore, insuring that the tread portion of rigid material will remain securely fixed to the resilient material of the base portion and not break off in use is not without problems too.

With the present invention, a primary object is, therefore, to form a cleat type gripping element with an insert of the type mentioned wherein the shearing and bending forces occurring on the tread surface cannot lead to the fracturing of the insert material or of its connection to the body of the cleat.

It is a further object of the invention to provide a cleat of abrasion resistant ceramic which is easily and economically producible.

These objects are achieved in accordance with a preferred embodiment of the invention by providing the cleat with an insert of rigid, highly abrasion resistant material of a shape wherein a midsection of the insert has a single constriction that divides the insert into a tread section having a tread surface and a fastening section; wherein the ratio of a maximum diameter of said tread section of the insert relative to the total height of the insert is about 1:0.75 to 1:1.8; wherein the height of constriction is 25% to 60% of the total height of the insert and wherein the smallest diameter of the constriction is 75% to 45% of the maximum diameter of said tread section.

Due to the formation of the cleat insert with a constriction according to the invention, the insert is anchored permanently in the cleat-shaped substructure. Despite this, the insert can be elastically deflected sideways in and with the cleat when strong forces, particularly shearing forces, occur in the edges areas, since the constriction forms a kind of bearing. Thus, for example, with forces acting at an angle of 30° to 70° on the edge, the insert can elastically, flexibly give way so that impact forces or loads can be reduced. Thus the danger of fracturing of the insert material, especially in the edge area of the insert, is greatly reduced. Furthermore, no bonding of the insert to another component is required.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

In the sole Figure of the drawings, the left half of the Figure shows a gripping element formed on the outsole and the right half of the drawing shows a gripping element detachably fastened in the sole.

DETAILED DESCRIPTION OF THE PREFERRED EMBODIMENT

Gripping element 1 consists of a cleat or cleat-shaped base portion 2 that is made of a stiff, elastic plastic, particularly polyurethane, polyimide, polyamide, polycarbonate, polyethylene, polypropylene or the like, or also made of mixtures of these materials. Basically, these materials can also incorporate reinforcements or stiffeners made of glass fibers, carbon fibers or the like so that the stiffness and hardness of the cleat-shaped base portion 2 is increased. Cleat-shaped base portion 2, preferably, has a hardness of 70 to 80 Shore A, preferably 75 Shore A. This kind of cleat-shaped base portion 2 also considerably decreases the cleat pressure on the foot of the wearer of the shoe.

In cleat-shaped base portion 2, an insert 3 is inserted. Insert 3 is made of a hard alloy or a ceramic material and is, preferably, incorporated into the gripping element 1 by casting, molding or coating thereof with the plastic material of the cleat-shaped base portion 2 during formation of base portion 2.

The insert has a constriction E approximately in its midsection. This constriction E divides insert 3 into a tread section 4, the said constriction E and a fastening section 5. Constriction E does not necessarily have to be in the middle of total height H of insert 3, but can, basically, be shifted downward or upward somewhat. In particular, constriction E can be shifted upward so far that it comes to lie about in the middle of what is shown in the drawing for fastening section 5. The height of constriction E is suitably about 25% to 60% of total height H of insert 3. Furthermore, the size of insert 3 is designed so that the ratio of the maximum diameter D of the tread portion 4 to the total height H of insert 3 is at least 1:0.75 to about 1:1.8. The smallest diameter e of constriction E is about 75% to 45% of the maximum diameter D of tread section 4. The inner surface 6 of insert 3, thus the surface of fastening section 5, can be flat or arched. Preferably, fastening section 5 has at least approximately the shape of a spherical segment whose radius R is smaller, particularly considerably smaller than total the height H of insert 3 (the largest suitable radius being approximated by that associated with the broken line representation of fastening section 5 and the smallest by that for the solid line representation). In this way a kind of ball-and-socket joint is achieved so that insert 3, under elastic deformation of base portion 2, can be deflected elastically to all sides (in a pivoting type of movement) but, due to the shape of constriction E, cannot be detached from cleat 2. Preferably the size of radius R is about 80% to 50% of total height H of insert 3.

To avoid a break in the area of constriction E, the adjacent parts, i.e., tread section, on the one hand, and fastening section 5, on the other hand, merge into each other by the greatest possible curves in an S shape. In doing so, segment 7, between tread section 4 and constriction E, can run straight for a bit or may be arched slightly outward, i.e., be convex. The line tangent to the turning point between tread section 4 and constriction E or on segment 7, preferably, makes an angle $\alpha$ of about 40° to 75° with tread plane 8. Thus, a good supporting surface is provided for in cleat-shaped gripping element 1.

Maximum diameter d of fastening section 5 is, preferably, about 75% to 120% of diameter D of tread section 4. Tread surface 9 of tread section 4 is slightly outwardly arched and its edge 10 is rounded. The distance between insert 3 and cleat foundation 11, a, (which equals the difference, N−H, between the height, H, of the insert 3 and height, N, of the gripping element 1) is about 1.5 mm to 8 mm, particularly 1.5 mm to 3 mm.

Base portion 2 may, as shown in the left half of the drawing, be integrally formed on sole 12 or on a particular part of outsole 12.1, for example glued on, cast on or injection molded. Alternatively, base portion 2 can be fastened on sole 12, in which case cleat foundation 11, as shown in the right half of the drawing, has a metal plate 13 with a fastening pin, for example, a threaded stem, attached to it, preferably by being glued on or formed on. In this case, base portion 2 has recesses 15, of the type known for lathe tools, for screwing it in and out of a threaded socket 14 embedded in sole 12. Optionally, recesses can also be provided on metal plate 13.

Base portion 2 may be formed as a cylinder but, preferably, it is formed as a truncated cone with smaller end 16 facing outward relative to sole 12. The central angle of the cone is then about 5° to 40°, particularly 10° to 20°.

As a material for forming insert 3, a hard alloy, for example with a base of chromium, nickel, titanium or tungsten, or ceramics based on metal oxides, particularly the metals aluminum, zircon, silicon, tungsten, titanium or mixtures of them as well as metal carbides or metal nitrides, particularly based on aluminum, silicon, titanium, zircon, or mixtures of them, are suitable.

The gripping elements formed according to the invention are especially suitable for outdoor sports on hard, abrasive surfaces. The preferred application is athletic shoes for team sports, such as soccer, field hockey, baseball, or the like. For such usage, the gripping elements have the cleat shape shown in the drawing.

From the foregoing, it should be apparent how the present invention is able to achieve the objects set forth above. The shape and mounting of the insert enable it to resiliently deflect with the elastic deformation of the base portion and ensures against fracturing, while the interlocking configuration eliminates the problem of the hard insert separating from the resilient base. Furthermore, the invention is susceptible to complete production of the gripping element during the sole forming process by forming the base portion of the gripping element as part of the sole and embedding the insert as the base portion is formed.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Gripping element for athletic shoes comprising a cleat having a base portion made of hard, elastic material with an insert projecting beyond the base portion, said insert being made of a rigid, highly abrasion resistant material; wherein a midsection of the insert has a single constriction that divides the insert into a tread section having a tread surface and a fastening section; herein the ratio of a maximum diameter of said tread section of the insert relative to the total height of the insert is about 1:0.75 to 1:1.8; wherein the height of constriction is 25% to 60% of total height of the insert and wherein the smallest diameter of the constriction is 75% to 45% of the maximum diameter of said tread section, whereby said insert resiliently deflects so as to move sideways with elastic deformation of said base due to radially imposed forces.

2. Gripping element according to claim 1, wherein an inner surface of the insert is at least approximately in the shape of a spherical segment whose radius is smaller than the total height of the insert.

3. Gripping element according to claim 2, wherein said radius of the inner surface of said insert is of a size that is about 50% to 80% of the total height of the insert.

4. Gripping element according to one of claim 1, wherein the tread section and fastening section merge into said constriction in an approximate S shape.

5. Gripping element according to claim 4, wherein a line tangent to a turning point between the tread section and the constriction makes an angle of about 40° to 75° with a tread plane.

6. Gripping element according to claim 1, wherein a line tangent to a turning point between the tread section and the constriction makes an angle of about 40° to 75° with a tread plane.

7. Gripping element according to claim 1, wherein a smallest diameter of the constriction is located at a distance from the highest elevation of the tread surface of about 55% to 80% of the total height of the insert.

8. Gripping element according to claim 1, wherein the maximum diameter of the fastening section is 75% to 120% of the maximum diameter of the tread section.

9. Gripping element according to claim 1, wherein the tread surface of the tread section is arched outward.

10. Gripping element according to one of claim 1, wherein a distance between a bottom end of the insert and a cleat foundation of the base portion is 1.5 mm to 8 mm.

11. Gripping element according to claim 1, wherein said base-portion is provided with a metal plate having a fastening pin on said cleat foundation as a means for attachment of said cleat to a shoe sole and wherein at least one of said base portions and said metal plate has recesses for a lathe tool to grip for turning of said fastening pin.

12. Gripping element according to claim 1, wherein said base portion is formed of a material selected from the group consisting of polyurethane, polyimide, polyamide, polycarbonate, polyethylene or of mixtures of these materials.

13. Gripping element according to one of claim 12, wherein said insert consists of a hard alloy.

14. Gripping element according to claim 12, wherein said insert consists of a ceramic.

15. Gripping element according to claim 14, wherein the ceramic is selected from the group consisting of at least a metal oxide, particularly aluminum, zircon, silicon, titanium, tungsten or of a metal carbide or nitride, particularly aluminum, silicon, titanium, tungsten, zircon or mixtures of them.

16. Gripping element according to one of claim 1, wherein said insert consists of hard alloy.

17. Gripping element according to claim 1, Wherein said insert consists of a ceramic.

18. Gripping element according to claim 17, wherein the ceramic is selected from the group consisting of at least a metal oxide, particularly aluminum, zircon, silicon, titanium, tungsten or of a metal carbide or nitride, particularly aluminum, silicon, titanium, tungsten, zircon or mixtures of them.

19. Gripping element according to claim 1, wherein said base portion is formed as a truncated cone with a smaller base facing outward.

20. Gripping element according to claim 19, wherein a central angle of the truncated cone is 5° to 40°.

21. A sole for an athletic shoe having an outer sole with at least one gripping element that comprises a cleat having a base portion made of hard, elastic material with an insert projecting beyond the base portion, said insert being made of a rigid, highly abrasion resistant material, wherein a midsection of the insert has a single constriction that divides the insert into a tread section having a tread surface and a fastening section; wherein the ratio of a maximum diameter of said tread section of the insert relative to the total height of the insert is about 1:0.75 to 1:1.8; wherein the height of constriction is 25% to 60% of total height of the insert and wherein the smallest diameter of the constriction is 75% to 45% of the maximum diameter of said tread section, whereby said insert resiliently deflects so as to move sideways with elastic deformation of said base due to radially imposed forces.

22. A sole according to claim 21, wherein said base portion is an integrally formed part of an outer sole.

23. A sole according to claim 22, wherein said insert is incorporated into said base portion by formation of said base portion thereabout.

24. A sole according to claim 21, wherein said insert is incorporated into said base portion by formation of said base portion thereabout.

25. A sole according to claim 24, wherein said base portion has means for detachably securing said cleat to said outer sole.

* * * * *